US006758709B2

(12) United States Patent
Murphy

(10) Patent No.: US 6,758,709 B2
(45) Date of Patent: Jul. 6, 2004

(54) ADJUSTABLE PLATE BINDING ASSEMBLY

(76) Inventor: Michael J. Murphy, 33124 Case St., Lake Elsinore, CA (US) 92530

( * ) Notice: Subject to any disclaimer, the term of this patent is extended or adjusted under 35 U.S.C. 154(b) by 0 days.

(21) Appl. No.: 10/353,220

(22) Filed: Jan. 27, 2003

(65) Prior Publication Data

US 2003/0143906 A1 Jul. 31, 2003

Related U.S. Application Data

(60) Provisional application No. 60/352,766, filed on Jan. 30, 2002.

(51) Int. Cl.[7] ..... B63B 35/85
(52) U.S. Cl. ..... 441/70; 441/72
(58) Field of Search ..... 441/70, 72

(56) References Cited

U.S. PATENT DOCUMENTS

| | | | |
|---|---|---|---|
| 2,452,280 | A | 10/1948 | Zahller |
| 2,707,986 | A | 5/1955 | Johnson |
| 2,721,088 | A | 10/1955 | Ritter, Jr. |
| 2,751,612 | A | 6/1956 | Shepard |
| 2,930,338 | A | 3/1960 | Flomenhoft |
| 2,931,332 | A | 4/1960 | Hebrank |
| 3,003,778 | A | 10/1961 | Taggart |
| 3,026,546 | A | 3/1962 | Kakes |
| 3,092,857 | A | 6/1963 | Churchman |
| 3,092,858 | A | 6/1963 | Wallach |
| 3,105,249 | A | 10/1963 | Palmore |
| 3,121,890 | A | 2/1964 | Rumsey, Jr. |
| 3,123,844 | A | 3/1964 | Bailey |
| 3,145,399 | A | 8/1964 | Jackson |
| 3,164,119 | A | 1/1965 | Emmanuel et al. |
| 3,182,341 | A | 5/1965 | Rieffle |
| 3,201,807 | A | 8/1965 | Weaver |
| 3,208,422 | A | 9/1965 | Schopmeyer |
| 3,216,031 | A | 11/1965 | Ingold, Jr. |
| 3,325,179 | A | 6/1967 | Bissett |
| 3,352,275 | A | 11/1967 | Wilson |
| 3,455,264 | A | 7/1969 | Castellani |
| 3,604,031 | A | 9/1971 | Cahill |
| 3,657,753 | A | 4/1972 | Le Blanc, Sr. |
| 3,688,723 | A | 9/1972 | Ulvesand et al. |

(List continued on next page.)

*Primary Examiner*—Stephen Avila
(74) *Attorney, Agent, or Firm*—Joseph E. Mueth

(57) ABSTRACT

A water sports device for supporting a seated human rider while the rider and the device are towed behind a powered water craft, the device including an elongated board having a front end and a back end to which is secured a seat for supporting the buttocks of the rider in a position spaced from and roughly centered above the back one-third of the board, a binding for securing the feet of the rider over the top of the board secured to the board, an elongated hydrofoil extends downward from the board and a planing blade secured to the hydrofoil spaced from the board, so as to be generally parallel to the board so that the planing blade provides essentially no lift when the board is horizontal. The improvement resides in enabling the rider of a personal sit down hydrofoil to adjust the binding to accommodate his/her leg length and increase the amount of control the rider has when mounted to the ski.

6 Claims, 5 Drawing Sheets

U.S. PATENT DOCUMENTS 3,744,811 A 7/1973 Johnston
3,747,138 A 7/1973 Morgan
3,803,653 A 4/1974 Trostad
3,996,868 A 12/1976 Schagen
4,014,283 A 3/1977 Crnogorac
4,028,761 A 6/1977 Taylor
4,159,689 A 7/1979 Odoj
4,193,609 A 3/1980 Bissett
4,260,036 A 4/1981 Bissett
4,280,715 A * 7/1981 Freelander et al. ..... 280/623
D261,022 S 9/1981 Hoskins
D265,116 S 6/1982 Churchill
4,361,103 A 11/1982 Willat
4,421,193 A 12/1983 Bissett
4,508,046 A 4/1985 Coulter et al.
4,593,926 A 6/1986 Pergola
4,669,992 A 6/1987 Morris
4,720,280 A 1/1988 Hufnagl et al.
4,857,025 A 8/1989 Brown et al.
4,857,026 A 8/1989 Hull
4,871,337 A * 10/1989 Harris ..... 441/70
5,100,354 A 3/1992 Woolley et al.
5,184,564 A 2/1993 Robbins et al.
5,249,998 A 10/1993 Woolley et al.
5,309,861 A 5/1994 Mardikian
5,329,870 A 7/1994 Cook
5,367,978 A 11/1994 Mardikian
5,518,080 A 5/1996 Pertile
5,544,607 A 8/1996 Rorabaugh et al.
5,603,281 A 2/1997 Harvey et al.
5,810,370 A * 9/1998 Covert et al. ..... 280/14.24
5,911,191 A 6/1999 Burer
5,911,611 A 6/1999 Saad
6,179,676 B1 1/2001 Wilborn et al.
6,386,932 B1 5/2002 Murphy

* cited by examiner

ADJUSTABLE PLATE BINDING ASSEMBLY

The patent application claims the benefit of the filing date of U.S. Provisional Patent Application No. 60/352,766, filed Jan. 30, 2002.

BACKGROUND OF INVENTION

U.S. Pat. No. 5,100,354, U.S. Pat. No. 5,249,998, U.S. Pat. No. 6,179,676 and U.S. Pat. No. 6,386,932 B1 disclose various and different water sport devices for supporting a seated human rider while the rider and the device are towed behind a powered water craft. The devices include an elongated board to which a rigidly mounted seat and foot holders are secured. An elongate strut or arm projects downwardly from the board and wings are secured to the arm generally parallel to the board. The positioning of the seat and the wings provide essentially no lift when the board is horizontal. The positioning of the rigidly mounted seat and the wings at the rear of the board, the use of a single vertical strut, the size of the wings and the positioning of the foot holders in front of the seat provides a water sports device which is relatively easy to ride, while at the same time being highly maneuverable and capable of high jumps.

These towable personal hydrofoils can be somewhat difficult to learn to ride. Hydrofoil riders often having difficulty bringing the hydrofoil up to the surface of the water from a starting, submerged position when first learning to ride.

The disclosures of U.S. Pat. Nos. 5,100,54, 5,249,998, 6,179,676 and U.S. Pat. No. 6,386,932 B1 are expressly incorporated herein by reference.

SUMMARY OF INVENTION

Briefly, the present invention comprises a water sports device for supporting a seated human rider while the rider and the device are towed behind a powered water craft, the device including an elongated board having a front end and a back end to which is secured a seat for supporting the buttocks of the rider in a position spaced from and roughly centered above the back one-third of the board, a binding for securing the feet of the rider over the top of the board secured to the board, an elongated hydrofoil extends downward from the board and a planing blade secured to the hydrofoil spaced from the board, so as to be generally parallel to the board so that the planing blade provides essentially no lift when the board is horizontal;

the improvement wherein the binding is adjustably secured to said board whereby rider can adjust the binding to accommodate his/her leg length and increase the amount to control the rider has when mounted on the ski.

Prior personal hydrofoils have only been equipped with stationary bindings which are permanently attached to the elongated board at a single, predetermined position. These fixed location bindings do not allow different size riders to adjust the binding forward or aft to fit their height requirements. According to this invention, the binding is adjusted by moving it forward to accommodate a tall person or aft to accommodate a shorter person. This makes an enormous difference in the amount of control a rider has when trying to steer or maneuver the sit down hydrofoil.

Specifically, the rider while seated can exert maximum steering action on the elongated board while the feet are held in bindings and the upper leg and lower leg are approximately at a right angle to each other, that is, there is approximately a 90° angle at the knee. For a short-legged rider, this means that the binding for securing the feet should be closer to the seat than is the case for a long-legged rider. This invention provides for this adjustability so that good control of steering can be done by simply moving the bent legs to the right or left while the feet are immobilized.

The adjustable binding assembly of this invention comprises:

a. a rigid plate having a hole pattern that matches the receiving threaded inserts inlayed in the elongated board.

b. affixed to the plate is a footpad and a multiple layer binding assembly of a toe rubber, heel strap and foot overlay as shown in the drawings.

c. the multiple layer of binding material mounts by hardware comprising of fasteners and binding rails which sandwich the binding material between the rail and plate.

The adjustable plate bindings mount toward the front of the elongated board using wing bolts, machine screws or other types of fasteners made of but not limited to, metal or a petroleum based composite material such as plastic. The receiving threaded inserts mount permanently within the board and are also made of a like metal or a petroleum based material such as plastic. The binding layers consist of, but are not limited to an e.v.a. type rubber. Engineering plastic suitable for the foregoing described purpose will be known to those skilled in the art.

DESCRIPTION OF PREFERRED EMBODIMENTS

Turning to the drawings.

Figure 1:
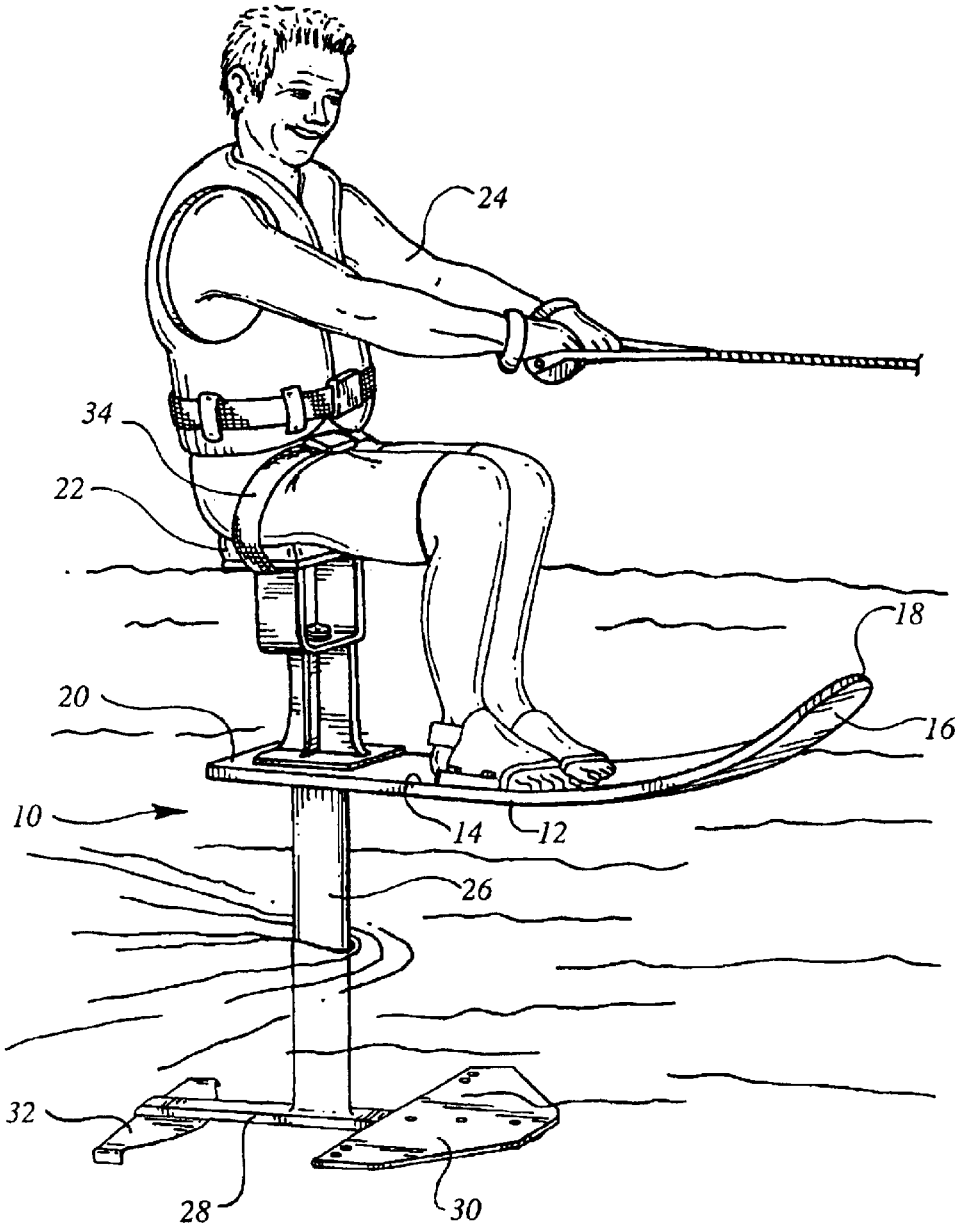
FIG. 1 is a perspective view of the device of this invention in a perspective view as it generally appears while in use.
Figure 2:
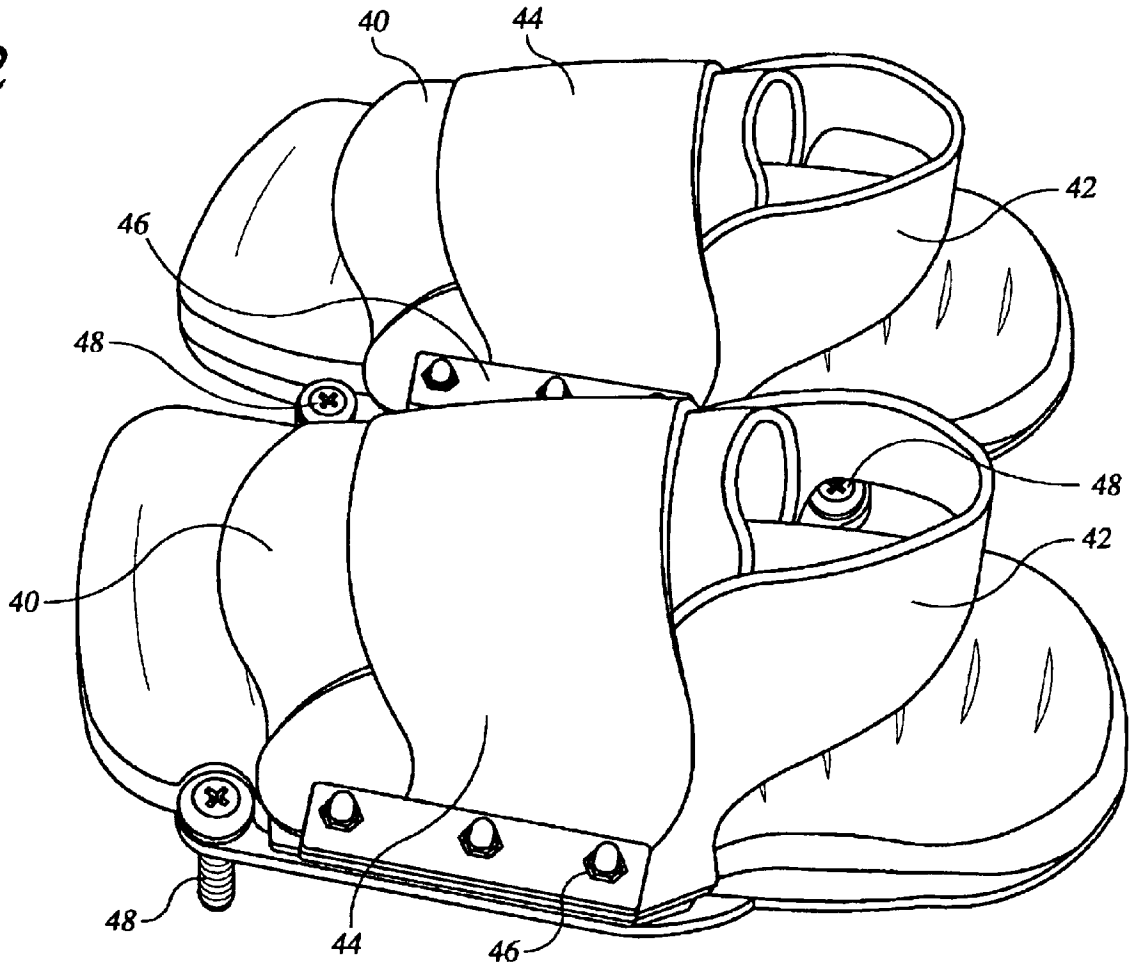
FIG. 2 is an enlarged perspective view of the foot piece of this invention.
Figure 3:
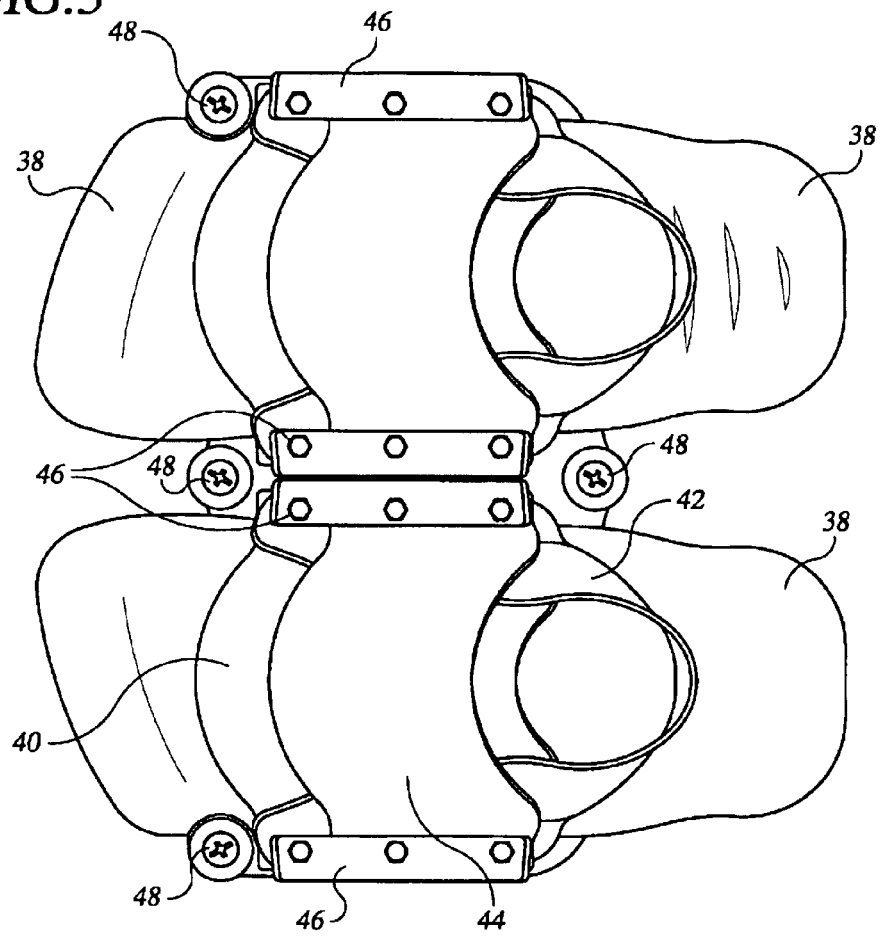
FIG. 3 is a top view of the foot piece of this invention.
Figure 4:
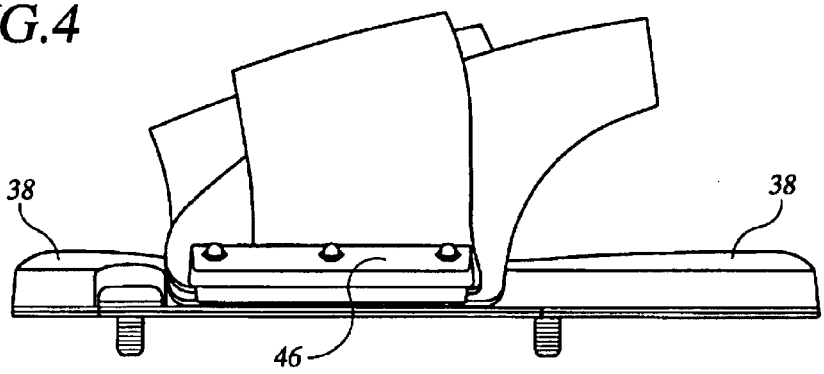
FIG. 4 is a side view of the foot piece of this invention.
Figure 5:
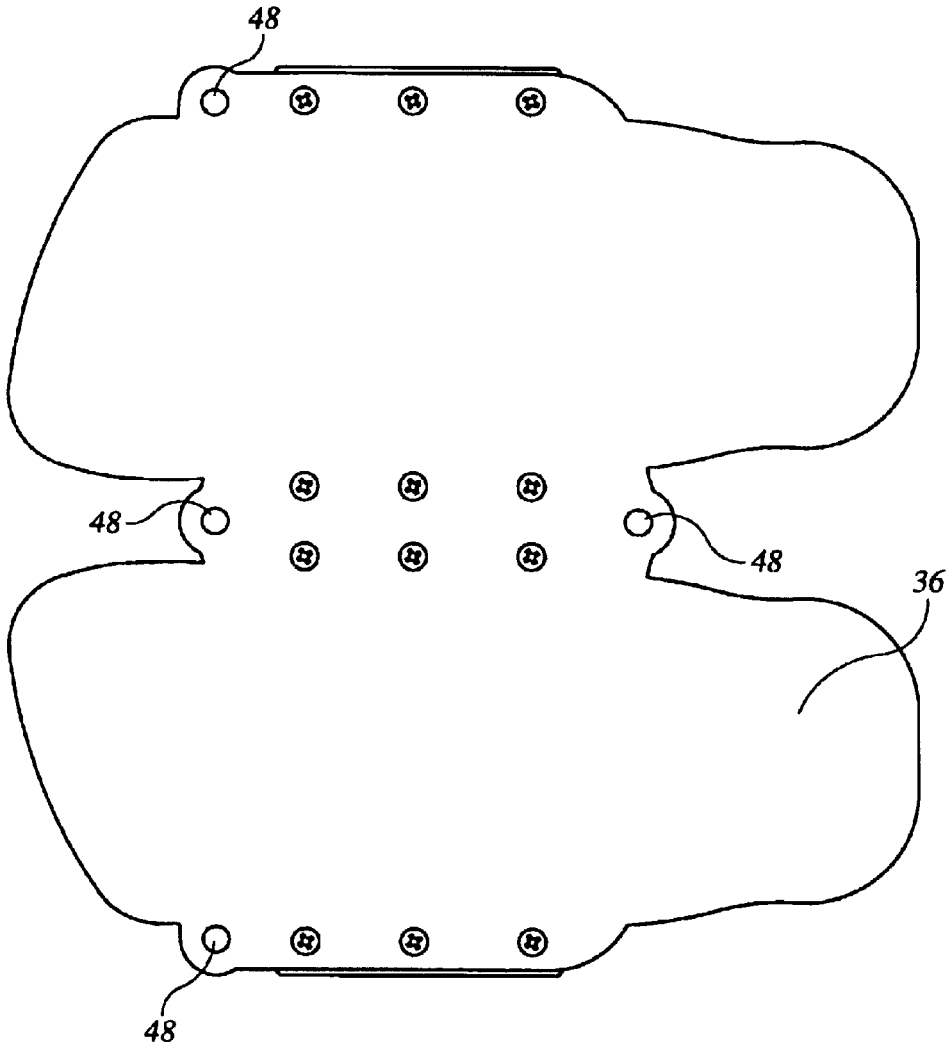
FIG. 5 is a bottom view of the foot piece of this invention.

Referring to FIG. 1, there is shown a "flying ski" 10 which embodies the preferred design of the water sports device present invention. The flying ski 10 includes an elongate board 12 having an upper surface 14 and a lower surface 16, and a front end 18 and a back end 20. A seat 22 extends generally perpendicular to and upward from the upper surface 14 of the board for supporting the buttocks of a seated rider 24 at a point spaced above the back of the board.

A hydrofoil 26 extends generally perpendicular to and thru a tight fitting opening in the board 10. The portion of hydrofoil 26 extending below the board 12 is of a water foil shape in cross section.

An elongate support 28 having a forward end and rearward end is fixed to the bottom end of the hydrofoil 26 at a point just forward of the middle of the support 28. A forward planing blade 30 is secured to the top of the forward end of the support 28 so as to be generally parallel to the board 12. Likewise, a rear planing blade 32 is secured to the bottom of the rearward end of the support 28 generally parallel to the board 12. A pair of vertical fins can be secured to the bottom of the rear planing blade 32 on either side of the support 28. The planing blade structure (i.e., the hydrofoil 26, the support 28, the forward planing blade 30, the rear planing blade 32), provides essentially no lift when the board 12 is horizontal.

The flying ski 10 and rider are desirably towed behind a standard powered water craft utilizing a standard ski tow rope, the handle of which is held by the rider (as illustrated in FIG. 1) at a point spaced roughly above the knees of the rider.

The water sports device is preferably provided with a seat belt 34 for securing the buttocks of the rider to the seat to protect the rider from being struck by the device in the event of a fall.

FIGS. 2 to 5 show the binding assembly which has a single piece rigid plate 36, a footpad 38 affixed to the plate, a multiple layer binding assembly having a flexible toe piece 40, flexible heel strap 42 and flexible foot overlay 44. Binding rails 46 are provided at the outside and inside margins or sides of the multiple layer binding assembly. The binding rails 46 sandwich the margins at the toe piece 40, heel strap 42 and foot overlay 44 between the rails 46 and the plate 36.

The toe piece 40, heel strap 42 and foot overlay 44 are normally elastic and flexible and are made of rubber.

Figure 6:
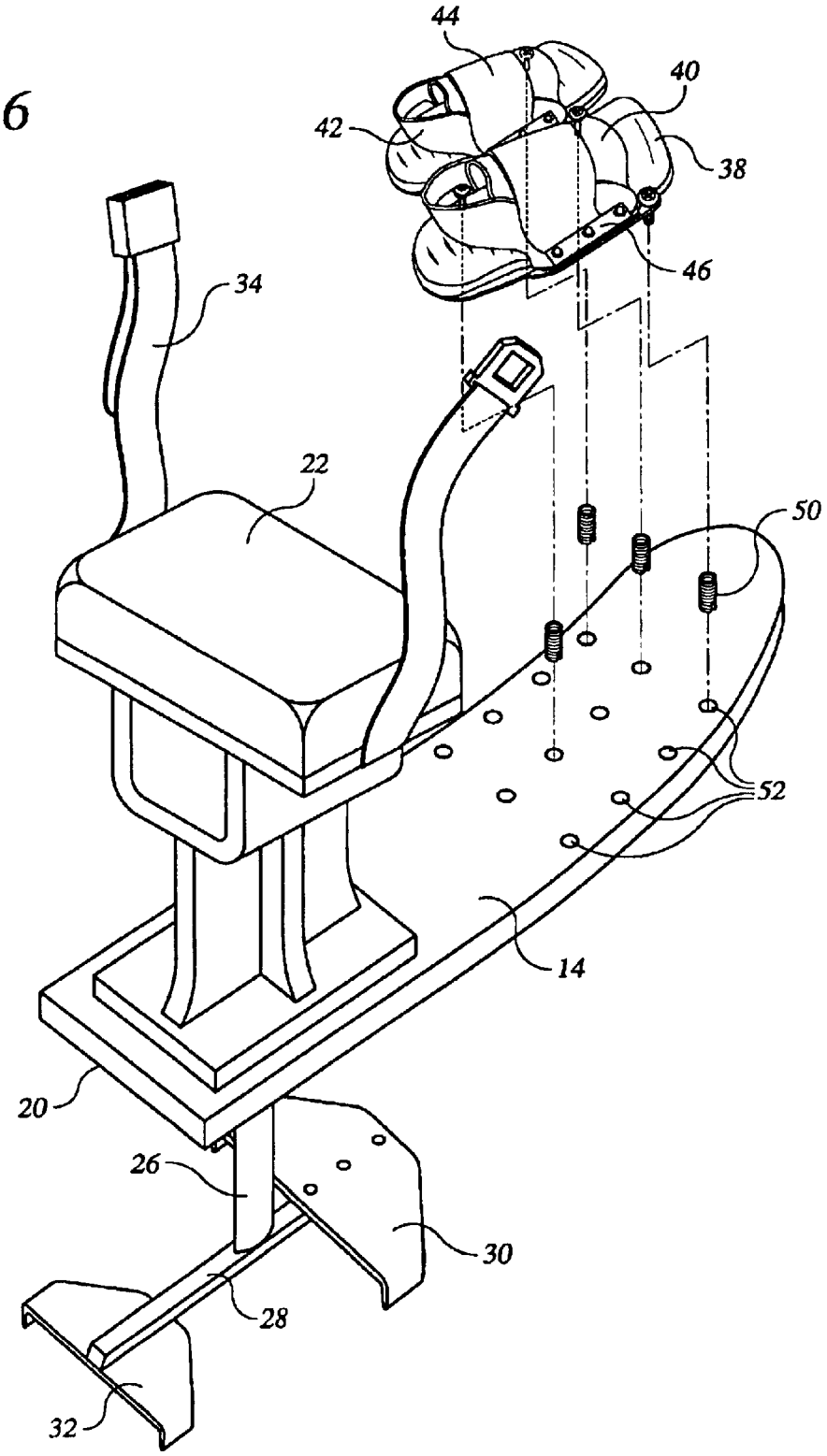
FIG. 6 is a exploded view showing how the foot piece is adjustably received on the waterspout device.

The plate 36 in the preferred embodiment has four bolts 48 running through it. The elongated board 12 has internally threaded inserts 50 received in holes 52 in the elongated board 12. FIG. 6 shows four threaded inserts. However, all of the holes 52 in the elongated board 12 are provided with permanent inserts. The inserts 50 are spaced to provide a series of hole patterns conforming to the spacing of the four bolt pattern in plate 12. Thus, the bolts 48 can be inserted as suggested in FIG. 6 to position plate 36 and the bindings at the forward most position for a tall or long-legged rider. If this positioning is found to be uncomfortable or unsatisfactory, the four bolts 48 can be undone and the plate 36 and binding can be re-located as a unit to the rear, closer to the seat, with the four bolts 48 being attached in inserts 50 in the elongated board located closer to the seat 22. The invention thereby provides a range of location options.

Having fully described the invention, the following claims are intended to particularly point out and distinctly claim the invention.

We claim:

1. A water sports device for supporting a seated human rider while the rider and the device are towed behind a powered water craft, the device including an elongated board having a front end and a back end to which is secured a seat for supporting the buttocks of the rider in a position spaced from and roughly centered above the back one-third of the board, a binding for securing the feet of the rider over the top of the board secured to the board, an elongated hydrofoil extends downward from the board and a planing blade secured to the hydrofoil spaced from the board, so as to be generally parallel to the board so that the planing blade provides essentially no lift when the board is horizontal;

the improvement wherein the binding is adjustably secured to said board such that the binding can be moved forwardly on said board away from said seat to accommodate a tall rider and an aft on said board toward said seat to accommodate a shorter rider whereby rider can adjust the binding to accommodate his/her leg length and increase the amount of control the rider has when mounted to the ski.

2. The device of claim 1 wherein the adjustable binding comprises a. a rigid plate having a hole pattern that matches receiving threaded inserts inlayed in the elongated board, b. affixed to the plate is a footpad and a multiple layer binding assembly of a toe rubber, heel strap and foot overlay, and the said multiple layer of binding material being mounted by hardware including fasteners and binding rails which sandwich the binding material between the rail and plate.

3. The device of claim 2 wherein the adjustable bindings mount towards the front of the board using wing bolts, machine screws or other types of fasteners, and the receiving threaded inserts are mounted permanently within the board.

4. The device of claim 3 wherein the fasteners are made of metal or plastic.

5. The device of claim 4 wherein said receiving threaded inserts are made of metal or plastic.

6. The device of claim 5 wherein the binding layers are made of rubber.

* * * * *